US005404789A

United States Patent [19]

Haas

[11] Patent Number: 5,404,789

[45] Date of Patent: Apr. 11, 1995

[54] GUN BORE EVACUATION

[75] Inventor: Jeffrey W. Haas, Troy, N.Y.

[73] Assignee: The United States of America as represented by the Secretary of the Army, Washington, D.C.

[21] Appl. No.: 300,260

[22] Filed: Sep. 2, 1994

[51] Int. Cl.[6] ..... F41A 13/08

[52] U.S. Cl. ..... 89/1.2

[58] Field of Search ..... 89/1.2

[56] References Cited

U.S. PATENT DOCUMENTS 2,807,986 10/1957 Howard et al. ..... 89/1
4,024,790 5/1977 Heiderer ..... 89/1 E
4,576,086 3/1986 Brandt ..... 89/43.01

FOREIGN PATENT DOCUMENTS 270469 1/1930 Italy ..... 89/1.2

*Primary Examiner*—Charles T. Jordan
*Assistant Examiner*—Christopher Keith Montgomery
*Attorney, Agent, or Firm*—Anthony T. Lane; Edward Goldberg; Michael C. Sachs

[57] ABSTRACT

A gun bore evacuator comprised of a main reservoir surrounding the gun tube, a bore in the tube, ports between the main reservoir and the bore, an auxiliary reservoir surrounding said tube, ports between said main reservoir and the bore, ports between the auxiliary reservoir and the bore, and check valves between the reservoirs.

3 Claims, 2 Drawing Sheets

GUN BORE EVACUATION

GOVERNMENT RIGHTS

The invention described herein may be manufactured, used and licensed by or for the Government for Governmental purposes.

FIELD OF THE INVENTION

The present invention relates generally to mechanisms for evacuating gases from gun bores after firing of a gun.

BACKGROUND OF THE INVENTION

When a gun mounted in a closed cab vehicle is being fired, it is desirable that the residual gasses resulting from the firing of one round be removed from the gun bore to prevent noxious gases from entering and accumulating in the crew compartment of the vehicle. Since it takes a few seconds for the crew to open the breech after the gun is fired and since the gases can only be evacuated from the gun bore when the breech is open, it is necessary for the forces causing the evacuation to be active for several seconds following the firing.

Muzzle mounted devices for purging the bore of residual propellant gases, known as bore evacuators, have been in use in various configurations for a number of decades, see U.S. Pat. No. 2,791,940 of May 14, 1957. In its simplest form it is essentially a closed annular reservoir surrounding a portion of the muzzle and tapped into the bore by a series of angled ports. During the firing cycle, the reservoir is pressurized to some operating pressure with propellant gases through the angled ports. As the pressure in the bore drops below that of the reservoir, the pent up propellant gases begin to discharge back into the bore through the ports which are angled towards the muzzle so as to induce a flow of air through the open breech, thus purging the bore.

In some gun designs, an additional set of ports that are located closer to the breech communicate with the reservoir so as to introduce more gas into it, but in order that the gas only pass from the reservoir to the gun bore via the first set of ports, check valves are provided for the additional ports. Since the additional check valves are in close contact with the high pressure high temperature gases in the bore, they are subjected to severe thermal and mechanical loads. Consequently, the valves are made with special alloys and frequent maintenance is required for proper functioning. Severe erosion and mechanical failure of the check valves are common.

BRIEF SUMMARY OF THE INVENTION

The present invention is directed to an improved bore evacuator in which the high temperature high pressure gases from the bore that are used to charge the evacuator are first expanded in an auxiliary reservoir to a considerably lower temperature and pressure. The gases then pass into the main reservoir from the auxiliary reservoir via one-way check valves when the pressure in the main reservoir is less than the pressure in the auxiliary reservoir. By pre-expanding the propellant gases in this manner the impact on the check valves is considerably reduced so that they need not be made of expensive special alloys. Furthermore, far less maintenance is required.

BRIEF DESCRIPTION OF THE DRAWINGS

Various embodiments of the invention are described below with reference to the drawings, in which like items are indicated by the same reference designation, wherein.

DETAILED DESCRIPTION OF THE INVENTION

Figure 1:
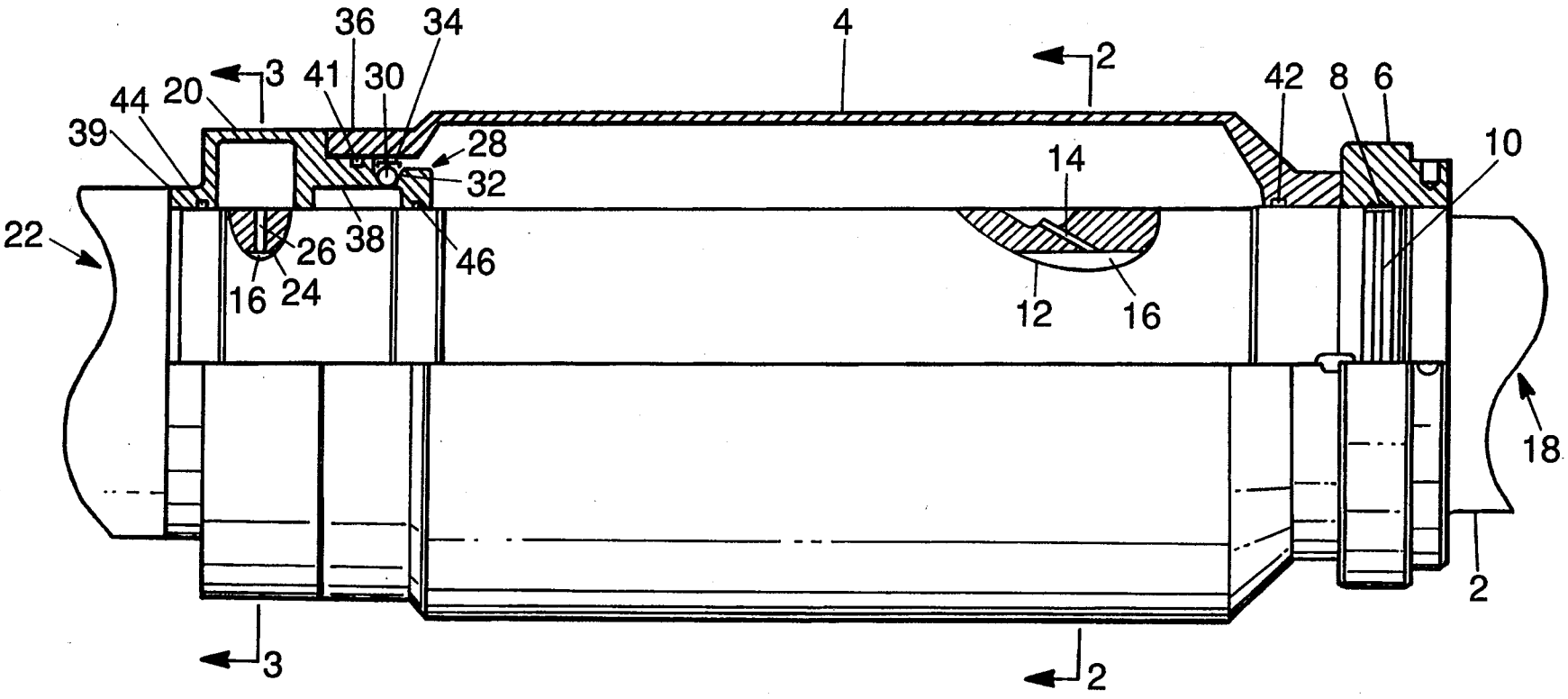
FIG. 1 is a side view of a gun incorporating the invention with certain portions shown in cross section.
Figure 2:
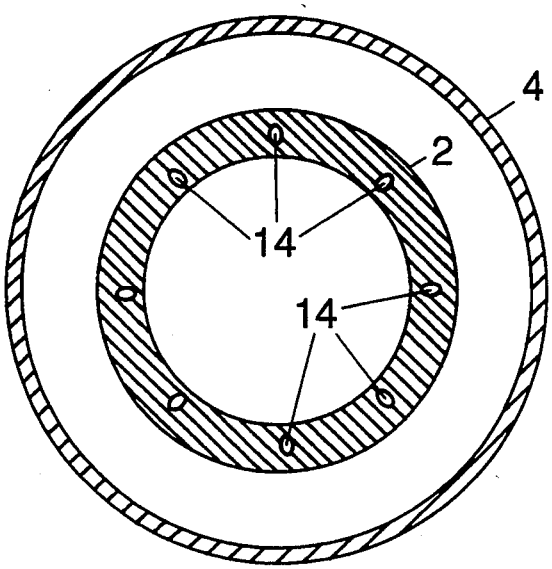
FIG. 2 is a cross section of a gun incorporating the invention that is perpendicular to the gun tube at 2,2 of FIG. 1.

In FIG. 1, a gun barrel or tube 2 is shown as being within a main reservoir 4 that is maintained in position by a locking collar 6 that may be secured to the tube 2 in any suitable manner as by threads 8 that mate with threads 10 on the outside of the tube 2. As shown in FIG. 2 there are a number of ports 14. As shown in the cut-out 12, a port 14 provides communication between the reservoir 4 and the bore 16 within the tube 2. They are all slanted toward the muzzle end 18 of the tube 2 so that gases escaping from the reservoir 4 are directed toward the muzzle.

Figure 3:
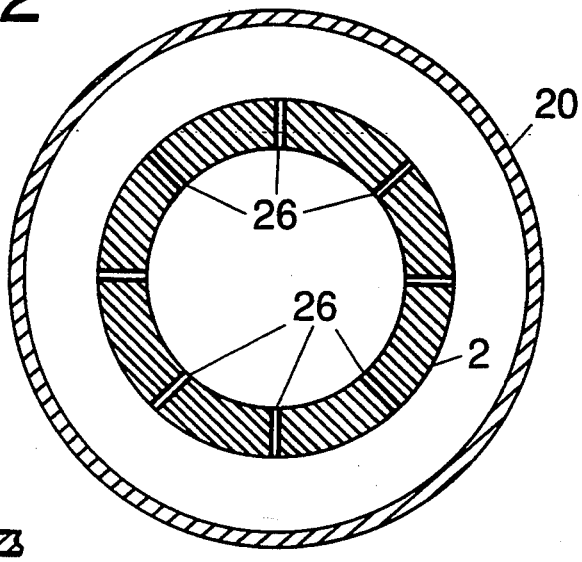
FIG. 3 is a cross section of a gun incorporating the invention that is perpendicular to the gun tube at 3,3 of FIG. 1.
Figure 4:
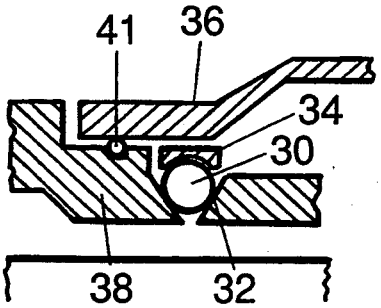
FIG. 4 is an enlarged view of the check valve in FIG. 2.

An auxiliary reservoir 20 is formed about the tube 2 at a location between the main reservoir 4 and the breech end 22 of the tube 2. As seen in the cut-out 24, a port 26 that is perpendicular to the tube 2 provides communication between the auxiliary reservoir 20 and the bore 16 of the tube 2. FIG. 3 shows that there are a number of such ports distributed about the tube 2.

Communication between the auxiliary reservoir 20 and the main reservoir 4 is via a check valve 28 herein shown as a ball 30 that is loosely retained in a tapered port 32 by a split ring 34. An enlarged view of the check valve is shown in FIG. 3. Thus, gas flows from the auxiliary reservoir 20 to the main reservoir 4 only when the pressure in the former exceeds the pressure in the latter.

In this particular design, the breech end 36 of the main reservoir 4 overlaps the muzzle end 38 of the auxiliary reservoir 20, and is retained by a shoulder 39 on the tube 2. An "O" ring 41 that is mounted in a groove in the end 38 is pressed between the ends so as to prevent gas from escaping from the main reservoir 4. Escape of gas from the other end, i.e. the muzzle end of the main reservoir 4 is prevented by an "O" ring 42. Escape of gas from the breech end of the auxiliary reservoir 20 is prevented by an "O" ring 44. An "O" ring 46 that is between the end 38 of the auxiliary reservoir 20 and the outside of the tube 2 prevents gas from passing between the reservoirs 4 and 20 so as to bypass the check valve 28.

During the firing cycle, propellant gases from the bore 16 enter the main reservoir 4 through the angled ports 14 and the pre-reservoir 20 through the perpendicular ports 26. Provided the gas pressure in the pre-reservoir 20 is greater than the gas pressure in the main reservoir 4, propellant gas will be transferred from the pre-reservoir to the main reservoir via the check valves 28.

When the pressures between the two reservoirs equalize, the check valves 28 close. As the pressure in the bore 16 drops below the pressure in the main reservoir, the bore evacuator operates in the normal fashion by discharging the pent up propellant gases back into the bore 16 through the angled ports 14, thus inducing air flow through the open breech.

It can be seen from inspection that the check valves 28 are exposed to gases of lower temperature and pressure gases than they would be if, as in the prior art, they were in direct contact with the bore 16 of the gun tube 2. This is because of the expansion of the gases in the auxiliary reservoir 20.

Although various embodiments of the invention have been shown and described herein, they are not meant to be limiting. Those of skill in the art may recognize certain modifications to these embodiments, which modifications are meant to be covered by the spirit and scope of the appended claims.

What is claimed is:

1. A gun bore evacuator comprising:

a gun tube having a bore therein, a muzzle end and a breech end;

means defining a main reservoir surrounding said tube;

a first plurality of ports distributed around said tube providing communication between said bore and said main reservoir;

means defining an auxiliary reservoir surrounding said tube at a location between said main reservoir and the breech end of said tube;

a second plurality of ports distributed around said tube providing communication between said bore and said auxiliary reservoir; and a plurality of check valves distributed around said gun tube and between said main and auxiliary reservoirs so as to provide communication between said main and auxiliary reservoirs only when pressure in said main reservoir is less than the pressure in said auxiliary reservoir.

2. A gun bore evacuator as set forth in claim 1 wherein said first plurality of ports respectively slant toward the muzzle end of said bore from said main reservoir.

3. A gun bore evacuator as set forth in claim 2 wherein said second plurality of ports are respectively perpendicular to said gun bore.

* * * * *